US008961335B2

(12) United States Patent
Sugimoto

(10) Patent No.: US 8,961,335 B2
(45) Date of Patent: Feb. 24, 2015

(54) GOLF CLUB HEAD

(71) Applicant: Dunlop Sports Co. Ltd., Kobe-shi, Hyogo (JP)

(72) Inventor: Yasushi Sugimoto, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 119 days.

(21) Appl. No.: 13/768,194

(22) Filed: Feb. 15, 2013

(65) Prior Publication Data

US 2013/0217514 A1 Aug. 22, 2013

(30) Foreign Application Priority Data

Feb. 16, 2012 (JP) ..... 2012-031924

(51) Int. Cl.
*A63B 53/04* (2006.01)

(52) U.S. Cl.
USPC ..... 473/332; 473/345

(58) Field of Classification Search
USPC ..... 473/345–346, 332, 339, 348
See application file for complete search history.

(56) References Cited

U.S. PATENT DOCUMENTS

| | | | | |
|---|---|---|---|---|
| 6,849,003 | B2 * | 2/2005 | Kumamoto | 473/305 |
| 7,344,450 | B2 * | 3/2008 | Billings | 473/324 |
| 7,455,600 | B2 * | 11/2008 | Imamoto et al. | 473/345 |
| 7,507,168 | B2 * | 3/2009 | Chou et al. | 473/346 |
| 7,510,485 | B2 * | 3/2009 | Yamamoto | 473/345 |
| 7,549,933 | B2 * | 6/2009 | Kumamoto | 473/329 |
| 7,691,008 | B2 * | 4/2010 | Oyama | 473/345 |
| 8,357,057 | B2 * | 1/2013 | Stites et al. | 473/339 |
| 8,414,422 | B2 * | 4/2013 | Peralta et al. | 473/334 |
| 8,444,506 | B2 * | 5/2013 | Watson et al. | 473/334 |
| 8,550,935 | B2 * | 10/2013 | Stites et al. | 473/324 |
| 8,608,591 | B2 * | 12/2013 | Chao et al. | 473/345 |
| 8,758,164 | B2 * | 6/2014 | Breier | 473/332 |
| 8,840,490 | B2 * | 9/2014 | Hayase et al. | 473/345 |
| 2007/0149313 | A1 * | 6/2007 | Matsunaga et al. | 473/332 |
| 2007/0155529 | A1 * | 7/2007 | Voges | 473/290 |
| 2008/0242445 | A1 | 10/2008 | Mergy et al. | |

FOREIGN PATENT DOCUMENTS

| | | | | |
|---|---|---|---|---|
| JP | 2008-246207 | A | 10/2008 | |
| WO | WO 2004052474 | A1 * | 6/2004 | A63B 53/04 |

* cited by examiner

*Primary Examiner* — Stephen L. Blau
(74) *Attorney, Agent, or Firm* — Birch, Stewart, Kolasch & Birch, LLP

(57) ABSTRACT

A hollow golf club head comprises a face portion with a face for hitting a ball on its front and a crown portion forming a top surface of the head, wherein the head comprises a face member including the face portion and made of a metallic material and a crown member attached to the face member to form the crown portion at least partially, the crown member includes a first member made of a metal material and a second member made of a fiber reinforced resin for supporting the first member so that the first member does not directly contact with the face member, the head has a primary natural frequency of from 3800 to 6500 Hz and an antinode when the head vibrates in the primary natural mode appears in the first member.

4 Claims, 9 Drawing Sheets

GOLF CLUB HEAD

BACKGROUND OF THE INVENTION

1. Field of the Invention

The present invention relates to a golf club head with excellent directional stability of a hit ball and hitting sound.

2. Description of the Related Art

In golf games, directional stability of a hit ball is important. In order to improve directionality of a hit ball, a golf club head having a crown portion or a sole portion made of fiber reinforced resin whose specific gravity is smaller than that of a metal material such as a titanium alloy and the like has been proposed. Such a head can be large in volume. Since such a head has large moment of inertia, directionality of a hit ball is stable even when a golfer misses a shot.

However, the golf club head as described above tends to have unfavorably low hitting sound due to the fiber reinforced resin. In addition, the head had a problem that due to a high vibration damping rate of the fiber reinforced resin, the hitting sound was less reverberant and the hit ball feeling was poor.

An object of the present invention is to provide a golf club head having excellent directional stability of a hit ball. In addition, other object of the present invention is to provide a golf club head which has excellent hitting sound and enables good hit ball feeling to be obtained.

SUMMARY OF THE INVENTION

In accordance with one aspect of the present invention, there is provided a hollow golf club head comprising a face portion having a face for hitting a golf ball on its front and a crown portion forming a top surface of the head, wherein the head comprises a face member including the face portion and made of a metallic material and a crown member attached to the face member to form the crown portion at least partially, the crown member includes a first member made of a metal material and a second member made of a fiber reinforced resin for supporting the first member so that the first member does not directly contact with the face member, the head has a primary natural frequency in a range of from 3800 to 6500 Hz and an anti node when the head vibrates in the primary natural mode appears in the first member.

In accordance with another aspect of the present invention, there is provided a hollow golf club head comprising a face portion having a face for hitting a golf ball on its front and a sole portion forming a bottom surface of the head, wherein the head comprises a face member including the face portion and made of a metallic material and a sole member attached to the face member to form the sole portion at least partially, the sole member includes a first member made of a metal material and a second member made of a fiber reinforced resin for supporting the first member so that the first member does not directly contact with the face member, the head has a primary natural frequency in a range of from 3800 to 6500 Hz and an antinode when the head vibrates in the primary natural mode appears in the first member.

In accordance with yet another aspect of the present invention, a hollow golf club head comprising a face portion having a face for hitting a golf ball on its front, a crown portion forming a top surface of the head and a sole portion forming a bottom surface of the head, wherein the head comprises a face member including the face portion and made of a metallic material, the crown portion includes an upper first portion made of a metal material and an upper second portion made of a fiber reinforced resin for supporting the upper first portion so that the upper first portion does not directly contact with the face member, the sole portion includes a lower first portion made of a metal material and a lower second portion made of a fiber reinforced resin for supporting the lower first portion so that the lower first portion does not directly contact with the face member, the head has a primary natural frequency in a range of from 3800 to 6500 Hz and an antinode when the head vibrates in the primary natural mode appears in the upper and lower first member.

DESCRIPTION OF THE PREFERRED EMBODIMENTS

Figure 1:
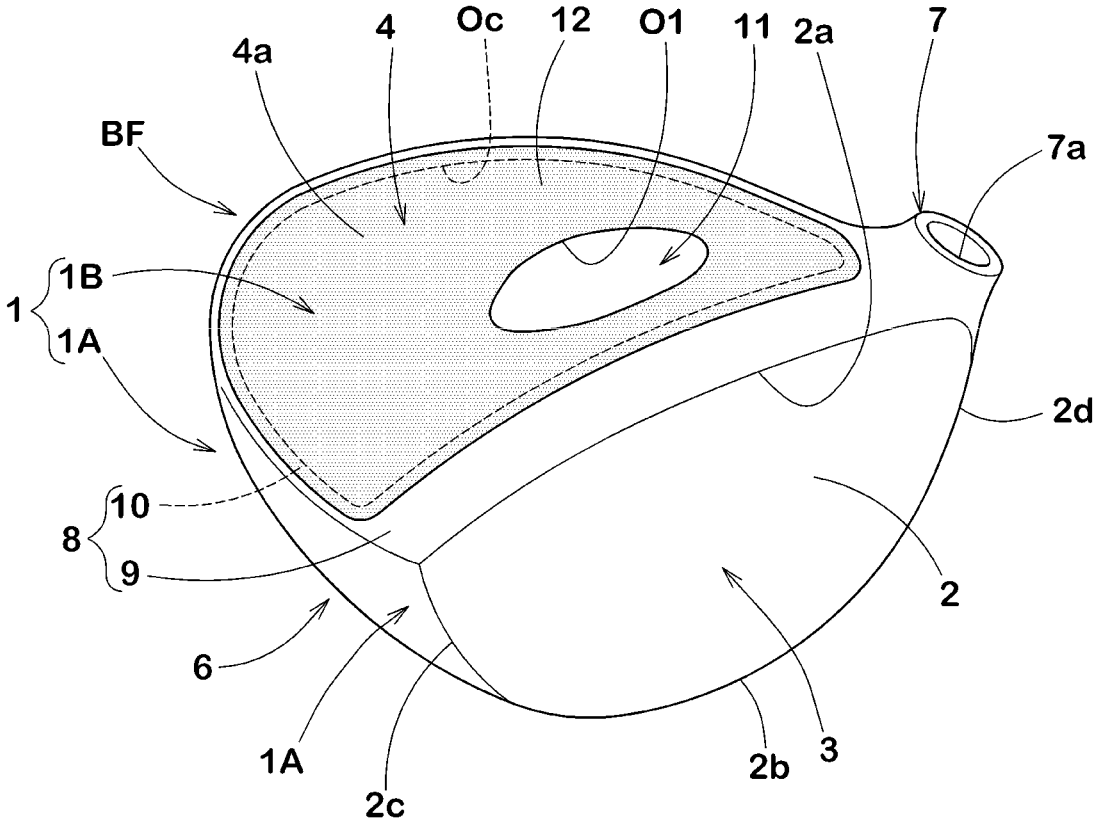
FIG. 1 is a perspective view of a standard state of a golf club head according to one embodiment of the present invention.

In the following, embodiments of the present invention will be described based on the drawings.

FIG. 1 to FIG. 4 show a hollow golf club head (which may be hereinafter simply referred to as a "head" or "club head") 1 under a standard state of this embodiment. Here, the standard state of the head 1 is a state in which not only a centerline CL of a shaft axis is disposed in a vertical plane VP and inclined at a specified lie angle, but also a sweet spot SS on a face 2 held at a loft angle β (a face angle is set to zero), is grounded on a horizontal plane HP. Unless otherwise stated, the club head 1 shall be in the standard state. In addition, the loft angle is given as an angle in a range of more than 0 degrees.

In the specification, a front-back direction of the head 1 is a direction TH parallel to a normal N extended down from a head center of gravity G to the face 2, when it is in planar view in the standard state. A toe-heel direction of the head 1 is a direction TK orthogonal to the normal N in the planar view. An intersection of the normal N and the face 2 is the sweet spot SS.

The head 1 comprises a face portion 3 having the face 2 for hitting a golf ball, a crown portion 4 which is connected to an upper edge 2*a* of the face 2 and forms a top surface of the head, a sole portion 5 which is connected to a lower edge 2*b* of the face 2 and forms a bottom surface of the head, a side portion 6 which connects between the crown portion 4 and the sole portion 5 and extends from a toe-side edge 2*c* of the face 2 to a heel-side edge 2*d* of the face 2 through a back face BF, and a hosel portion 7 having a cylindrically shaped shaft insertion hole 7*a* which is provided on a heel side of the crown portion 4 and into which a golf club shaft (not shown) is inserted. A golf club is manufactured by attaching the golf club shaft into the shaft insertion hole 7*a* of the hosel portion 7.

The head 1 has a hollow structure in which a hollow part i is provided therein and is preferably configured as a wood type. A golf club head of the wood type includes at least Driver (#1), Brassy (#2), spoon (#3), Baffy (#4), and creek (#5), and also includes a club which differs from those listed in the golf club number or a name but has an almost similar shape.

Although no specific limitation is set on volume of the head 1, it is preferably 200 $cm^3$ or more and more preferably 220 $cm^3$ or more. Such a head 1 provides a large moment of inertia and deeper center of gravity. The volume of the club head 1 is preferably 460 $cm^3$ or less.

Preferably, the head 1 has a weight in a range of not less than 180 g, more preferably not less than 185 g, but preferably not more than 210 g, more preferably not more than 205 g.

The club head 1 of this embodiment includes a face member 1A including the face portion 3 and a crown member 1B.

The face member 1A is made of a metal material and comprises a crown opening (Oc) in the crown portion 4. The crown member 1B is attached to the face member 1A so as to close the crown opening (Oc).

In this embodiment, the crown opening (Oc) does not project from the crown portion 4 and is fitted in that region. With this, as well shown in FIG. 4, the face member 1A comprises the face portion 3, sole portion 5, side portion 6, hosel portion 7, and a crown edge portion 8 which forms a periphery of the crown opening (Oc) in the crown portion 4. The crown opening (Oc) may be provided so as to bridge over the crown portion 4 and side portion 6, for example.

In order to improve productivity, in the face member 1A of the embodiment, it is desirable that the face portion 3, sole portion 5, side portion 6, hosel portion 7, and crown edge portion 8 are integrally molded in advance as with a lost-wax precision cast. As other embodiment, the face member 1A may also be manufactured by bonding two or more parts consisting of a forging, cast, or rolled stock.

Although a metal material forming the face member 1A is not specifically limited, preferably, stainless steel, maraging steel, pure titanium, or titanium alloy and the like is adopted.

Although a contour shape of the crown opening (Oc) is not specifically limited, it is formed of a smooth curve almost following a contour of the crown portion 4 to prevent concentration of stress and the like.

Figure 3:
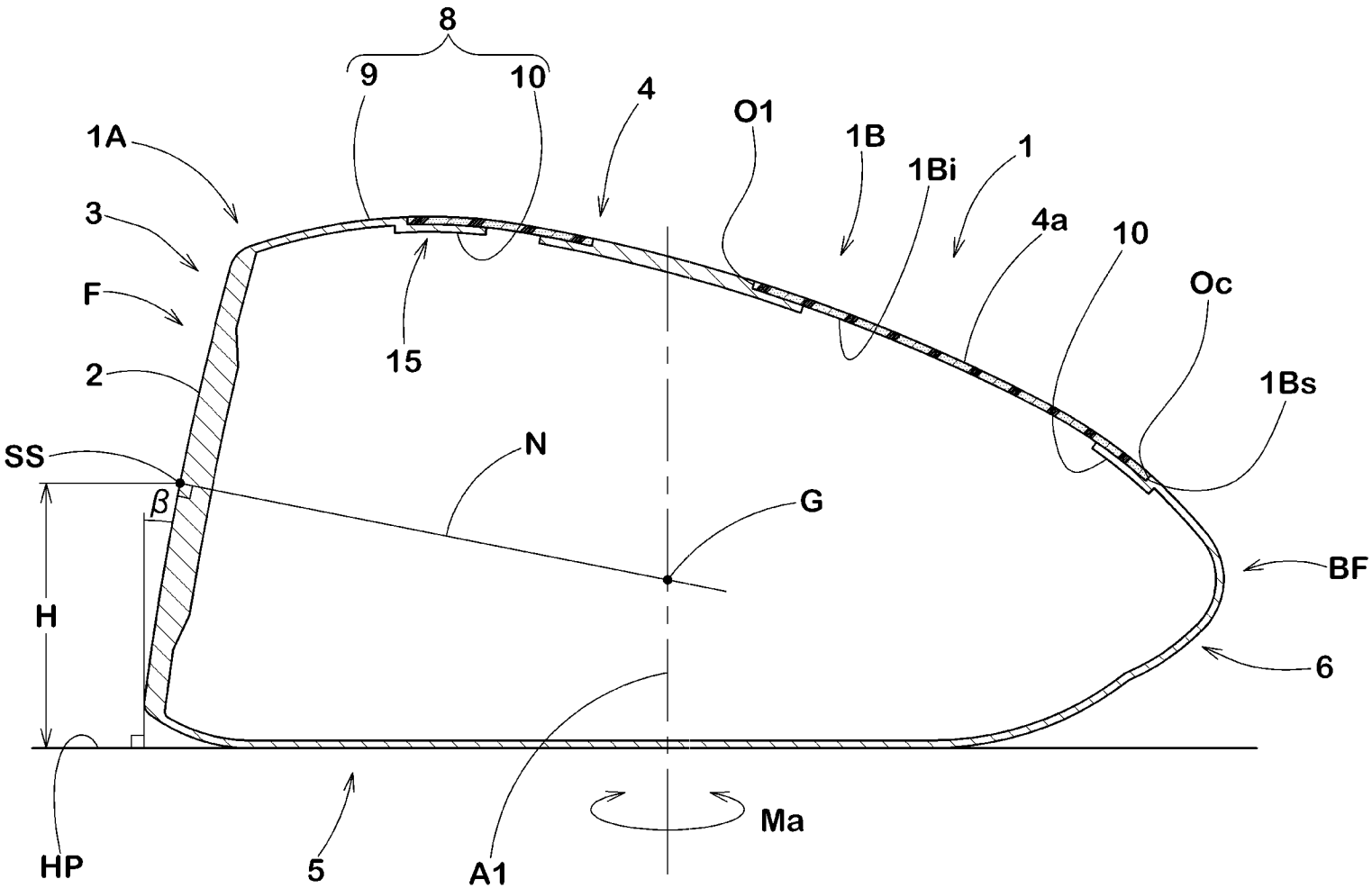
FIG. 3 is a cross sectional view of A-A of FIG. 2.

As well shown in FIG. 3, the crown edge portion 8 includes a main portion 9 substantially forming an outer surface 4*a* (finished surface) of the crown portion 4 and a receiving portion 10 depressed from the outer surface 4*a* like a step. The receiving portion 10 is placed on an inner surface 1Bi of the crown member 1B and periphery 1Bs. The inner surface 1Bi of the crown member 1B is a surface facing the hollow part (i) of the head 1.

In this embodiment, both the main portion 9 and the receiving portion 10 are provided by annularly continuing around the crown opening (Oc) to prevent concentration of stress on the outer edge of the crown member 1B.

The crown member 1B includes a first member 11 made of a metal material and a second member 12 made of fiber reinforced resin for supporting the first member 11 so that the first member 11 does not directly contact with the face member 1A.

Since the second member 12 made of fiber reinforced resin results in a large weight margin, such a head 1 may have large head volume and large moment of inertia. Moreover, since the first member 11 made of a metal material is provided in the crown portion 4, high-pitched hitting sound may be obtained. In addition, since the first member 11 is not in touch with the face member 1A (they are not integrally connected), the first member 11 may freely vibrate independent of the face member 1A. This allows the head 1 to provide a long reverberant sound. Moreover, since the crown portion 4 includes the second member 12, substantial weight reduction effect may be obtained on the upper side of the head, thereby enabling the head 1 to have low center of gravity.

In the specification, "moment of inertia" means moment of inertia Ma around a vertical axis A1 passing through the head center of gravity G in the standard state. This moment of inertia may be simply referred to as "right and left moment of inertia".

Figure 4:
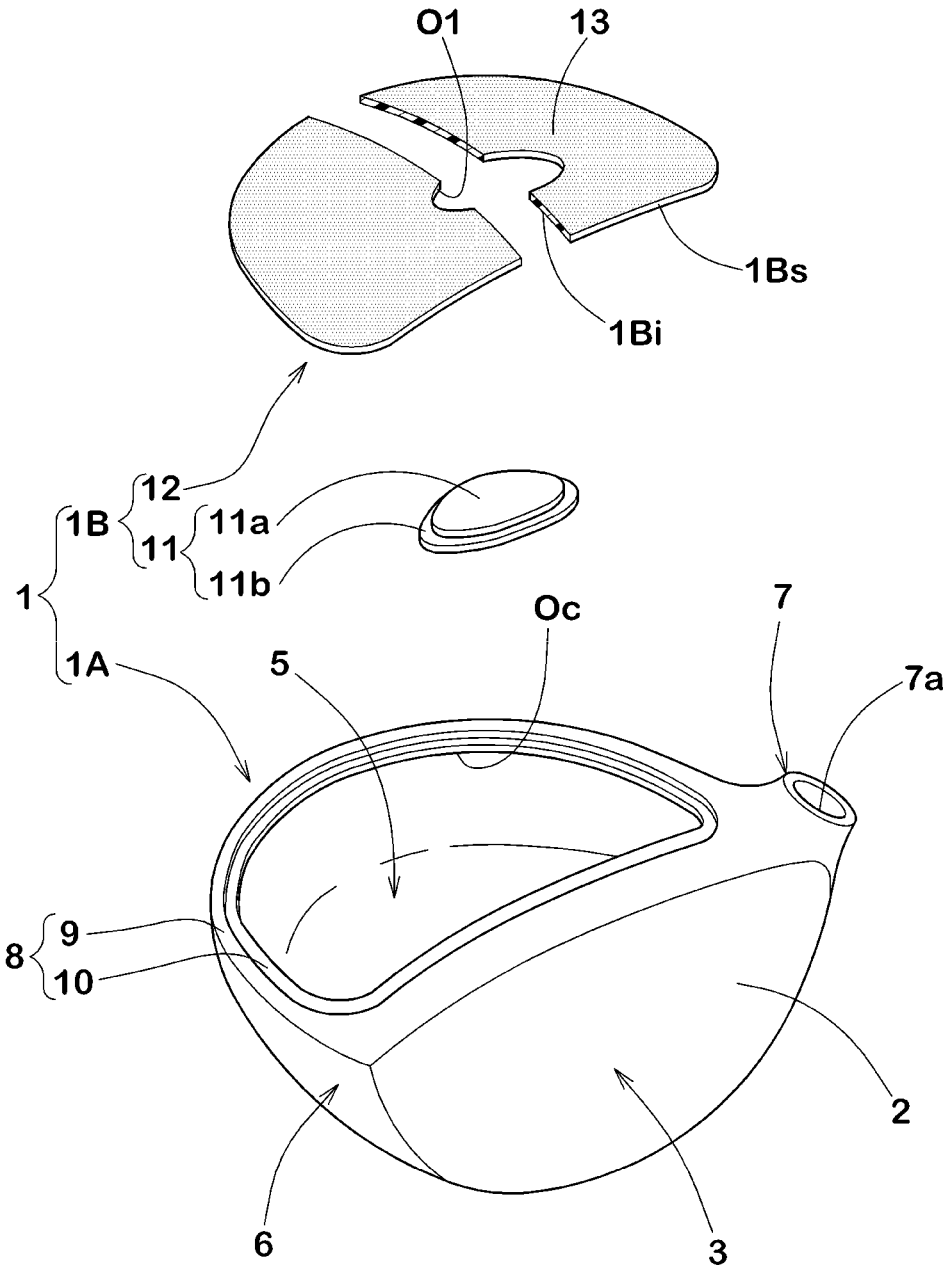
FIG. 4 is an exploded perspective view of FIG. 1.

As well shown in FIG. 4, the first member 11 of the embodiment has an external surface 11*a* forming the outer surface 4*a* of the crown portion 4 and a step surface 11*b* fitted into the second member 12 and depressed from the external surface 11*a* like a step.

The second member 12 of the embodiment includes a first opening o1 in which the first member 11 is disposed and a first periphery 13 which surrounds the first opening o1 and extends annularly, and is formed like a plate. Specifically, in the embodiment, the first periphery 13 prevents the first member 11 from being in touch with the face member 1A.

It is desirable that the step surface 11*b* of the first member 11 is fixed to the first periphery 13 of the second member 12 by, for example, an adhesive and the like.

Although a metal material forming the first member 11 is not specifically limited, in order to keep hitting sound high-pitched, for example, a titanium alloy, stainless alloy, magnesium alloy, and aluminum alloy and the like are desirable.

Matrix resins to be used in the fiber reinforced resin forming the second member 12 include thermosetting resin or thermoplastic resin, for example. The thermosetting resin includes, for example, epoxy resin, unsaturated polyester resin, phenol resin or polyurethane resin and the like. In addition, the thermoplastic resin includes polyamide resin, saturated polyester resin, polystyrene resin, polyethylene resin and AS resin or polypropylene resin.

Reinforcing fiber to be used in fiber reinforced resin includes, for example, inorganic fiber such as carbon fiber, glass fiber, boron fiber, silicon carbide fiber or alumina fiber, organic fiber such as polyethylene or polyamide and the like, and furthermore metal fiber. One or more type of them may be used.

In order to ensure the durability of the head, the tensile modulus of elasticity of the reinforcing fiber is preferably set in a range of not less than 50 GPa, more preferably not less than 100 GPa, but not more than 450 GPa, more preferably not more than 350 GPa, when measured according to the testing method prescribed in the Japanese Industrial standard R 7601. If a plural number kinds of fibers having different moduli are used, the average of the tensile moduli weighted by the fiber weights according to the following equation is used instead.

$$\Sigma(Ei \times Vi)/(Vi(i(1,2,\ldots)$$

Where, "Ei" is the tensile modulus of elasticity of fiber "fi", and "vi" is the gross weight of the fiber "fi". For example, two kinds of fibers f1 and f2 are used, the average of the tensile moduli is: E1×V1/(V1(v2) ((E2×V2/(V1(v2).

The second member 12 can be molded with a variety of methods. For example, the second member 12 is manufactured by placing a laminate of plural prepreg sheets in a die and applying heat and pressure to the die. The second member 12 is disposed in the receiving portion 10 of the crown opening (Oc), and integrally bonded to the face member 1A by an adhesive and the like, for example.

The head 1 of the embodiment has a primary natural frequency in a range of from 3800 to 6500 Hz. This enables comfortable hitting sound to be obtained, thereby improving feeling when a golfer hits a ball. The primary natural frequency of the head 1 is preferably in a range of not less than 4000 Hz, more preferably not less than 4300, but preferably not more than 6000 Hz, more preferably not more than 5500 Hz.

For the head 1 of the embodiment, an antinode when the head 1 vibrates in the primary natural mode appears in the first member 11 of the crown portion 4. The antinode of vibration is a position where amplitude of vibration is wide and where vibration easily occurs. Since the first member 11 is disposed in this position with the face member 1A including the face portion 3 separated, reverberation of hitting sound continues long and better hit feeling may be obtained.

In order to more effectively exhibit the action mentioned above, the antinode in the primary natural mode preferably appears at the center of gravity (centroid in the top view in the standard state) Za of the first member 11 in a planar view.

The "primary natural frequency of the head 1" means minimum natural frequency of the natural frequency of the entire head to be obtained in a modal analysis. In addition, the "natural mode" means "vibration shape inherent in an object". Specifically, the "primary frequency mode" is minimum natural vibration shape in the entire head to be obtained in the modal analysis.

A test analysis (also referred to as an experiment modal analysis) or a simulation analysis is used for the "modal analysis". In the test analysis, a natural mode is determined based on a result of an excitation experiment. In the simulation analysis, a natural mode is determined by a numerical analysis such as a finite element method and the like, for example. It is desirable that such a mode analysis is performed under free support conditions in which a condition of constraint is made free.

In the test analysis, the natural mode is determined by attaching a string to any member (end face on a neck side, for example) of a head, hitting each part of the head with an impact hammer with the head suspended from the string, and measuring a transmission function of acceleration response at the center of the face.

In the simulation analysis, for example, commercially available eigenvalue analysis software is used. As such software, for example, products named "ABAQUS" (manufactured by ABAQUS Inc.) or MARC (manufactured by MSC Software Corporation) and "IDEAS" (manufactured by EDS PLM Solutions Inc.) and the like are preferred. In the software, such elements as outline of the golf club head 1, thickness of each part, kind of material (physical property), etc. are used as a variable.

Figure 5:
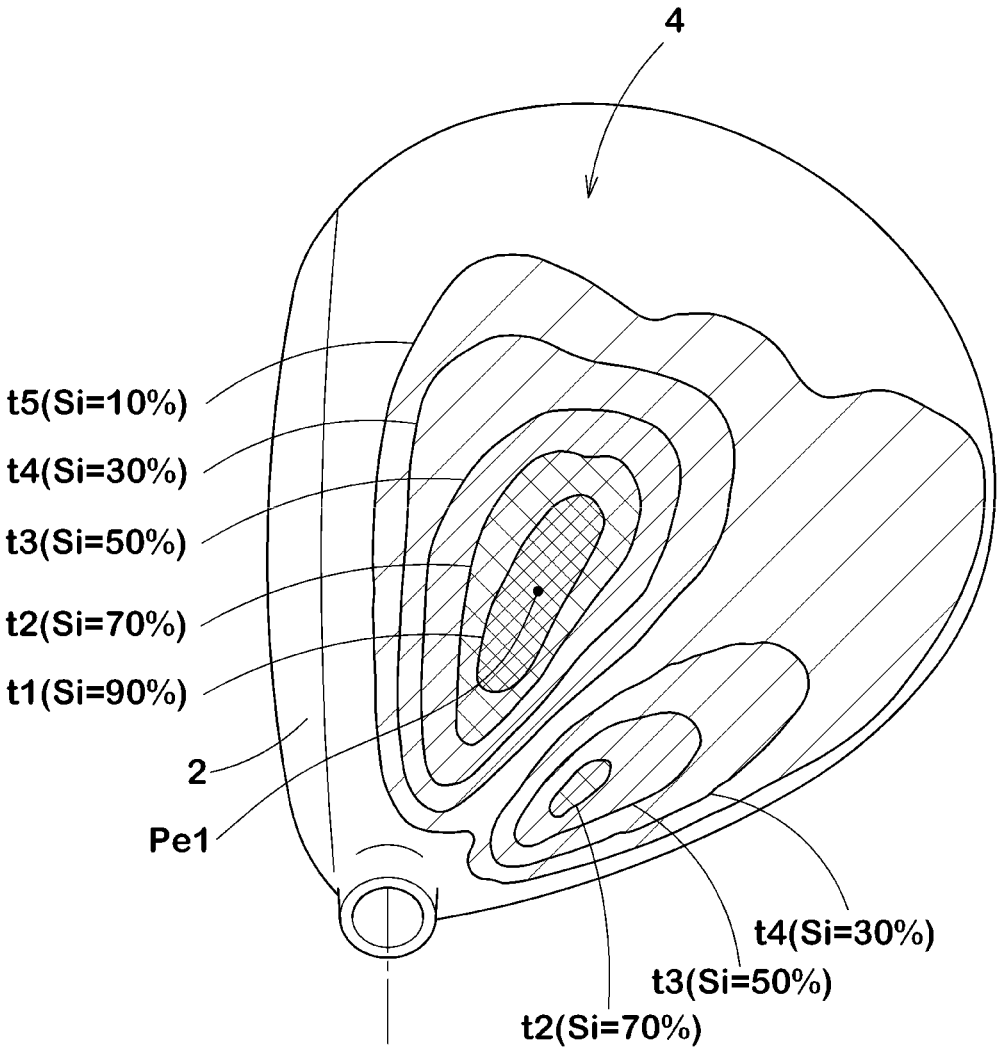
FIG. 5 is a head top view showing results of analysis of amplitude of a golf club head by the finite element method.

FIG. 5 shows a result of the primary natural mode of the crown portion 4 obtained by simulation analyzing the head of FIG. 1 with the finite element method. FIG. 5 also shows contour lines of amplitude in the primary natural mode. The sign si is a ratio of amplitude to maximum amplitude, and amplitude ratios in respective regions t1 to t5 are as follows:

t1: si=90%,
t2: si=70%,
t3: Si=50%,
t4: Si=30% and
t5: Si=10%.

FIG. 5 shows the maximum amplitude point Pe1 having the largest amplitude of the primary natural mode. As such, the modal analysis can enable the antinode of the natural mode to be determined.

with the modal analysis, the natural mode and antinode of vibration in the natural mode in each part of the sole portion 5, side portion 6, and face portion 3 as well as the crown portion 4 can be determined.

It was turned out from results of various experiments that the antinode of the vibration in the primary natural mode preferably appears in the first member 11. In other words, in a planar view of the head 1 in the standard state, the first member 11 is preferably disposed in a region where the amplitude ratio si is in a range of not less than 70%. With this, reverberation of hitting sound continues long and hit feeling improves. Desirably, it is desired that at least a part of the first member 11 is positioned in the region where the amplitude ratio si is in a range of not less than 90%.

In order to more effectively exhibit the action mentioned above, in the planar view shown in FIG. 2, an area of the first member 11 is preferably in a range of not less than 300 $mm^2$, more preferably not less than 450 $mm^2$, but preferably not more than 1200 $mm^2$, more preferably not more than 1000 $mm^2$. From a similar point of view, weight of the first member 11 is preferably in a range of not less than 1.0 g, more preferably not less than 2.0 g, but preferably not more than 6.0 g, more preferably not more than 5.0 g.

Although a shape of the first member 11 is not specifically limited, a circular or ellipse shape is adopted, for example. In the planar view shown in FIG. 2, the first member 11 has an ellipse shape. Such a first member 11 sustains reverberation long. A ratio rb/ra of a long diameter "ra" to a short diameter "rb" of the first member 11 is preferably in a range of not less than 40%, more preferably not less than 50%, but preferably not more than 80%, more preferably not more than 70%.

In order to more effectively exhibit the action mentioned above, the long diameter "ra" of the first member 11 preferably has an angle θ in a range of not more than 13 degrees, and more preferably not more than 7 degrees with respect to the toe-heel direaction TK.

Figure 2:
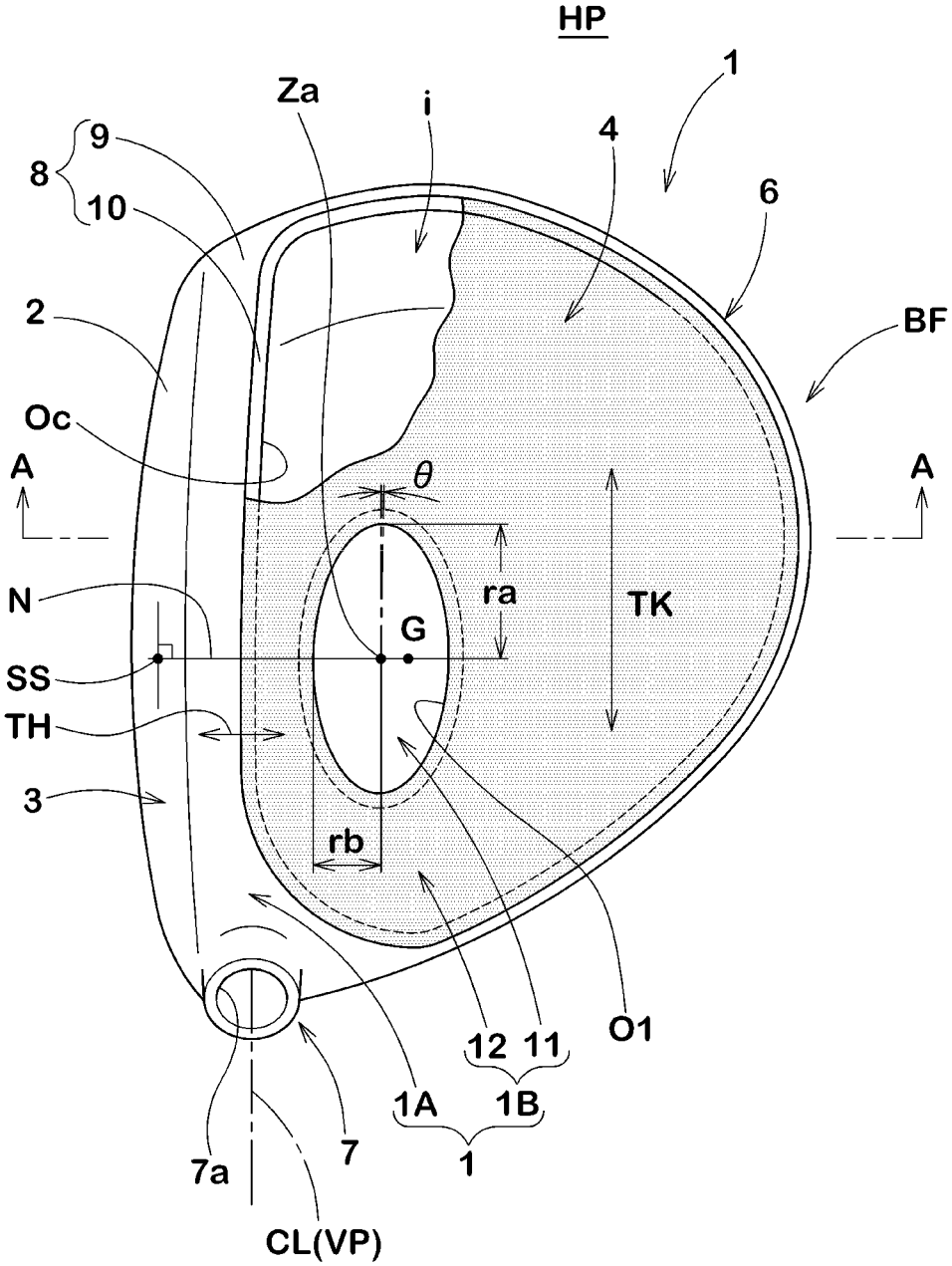
FIG. 2 is a plan view of FIG. 1.

In the planar view shown in FIG. 2, the second member 12 has preferably an area of from 20 to 80 $cm^2$. Such a second member 12 may provide large weight margin and durability of the excellent crown portion 4.

Figure 6:
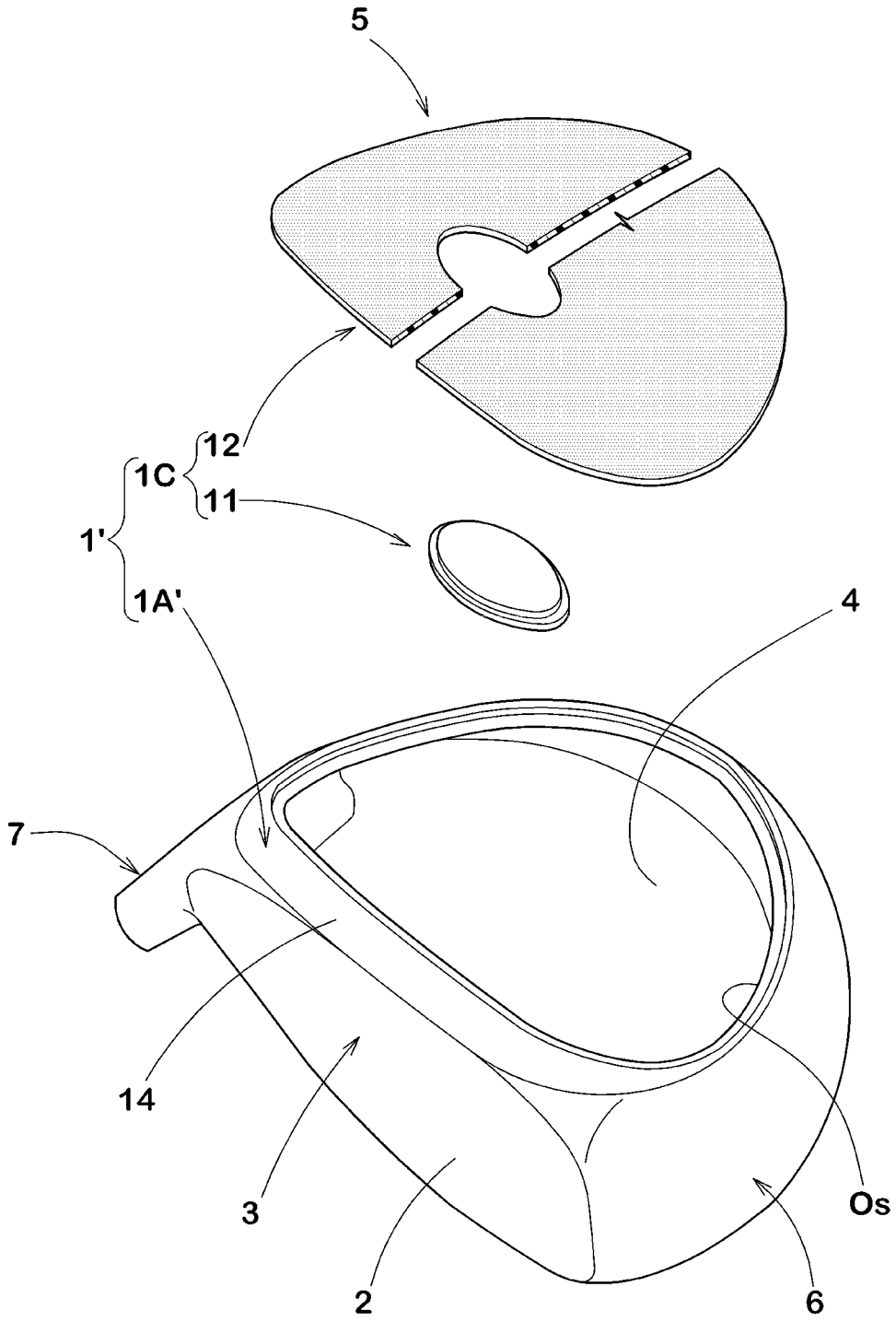
FIG. 6 is an exploded perspective views of other embodiment of the present invention.

FIG. 6 shows a head 1' of another embodiment of the present invention. The head 1' includes a face member 1A' made of a metal material and a sole member 1C.

The face member 1A' comprises at least the face portion 3 and a sole opening (Os) provided in the sole portion 5. In this embodiment, the sole opening (Os) does not project from the sole portion 5 and is fitted in that region thereof. In the face member 1A' of the embodiment, the face portion 3, a crown portion 4, a side portion 6, a hosel portion 7 and a sole edge portion 14 provided around the sole opening (Os) are integrally molded in advance. In this embodiment, the face member 1A' is made of a cast (more specifically, a lost-wax precision cast).

The sole member 1C has a plate-shape and is attached to the face member 1A' so as to close the sole opening (Os). The sole member 1*c* includes a first member 11 made of a metal material and a second member 12 made of a fiber reinforced resin. The second member 12 supports the first member 11 so that the first member 11 does not directly contact with the face member 1A.

Furthermore, the head 1' has a primary natural frequency in a range of from 3800 to 6500 Hz. In addition, for the head 1', an anti node when the head '1 vibrates in the primary natural mode appears in the first member 11 of the sole portion 5.

Figure 7:
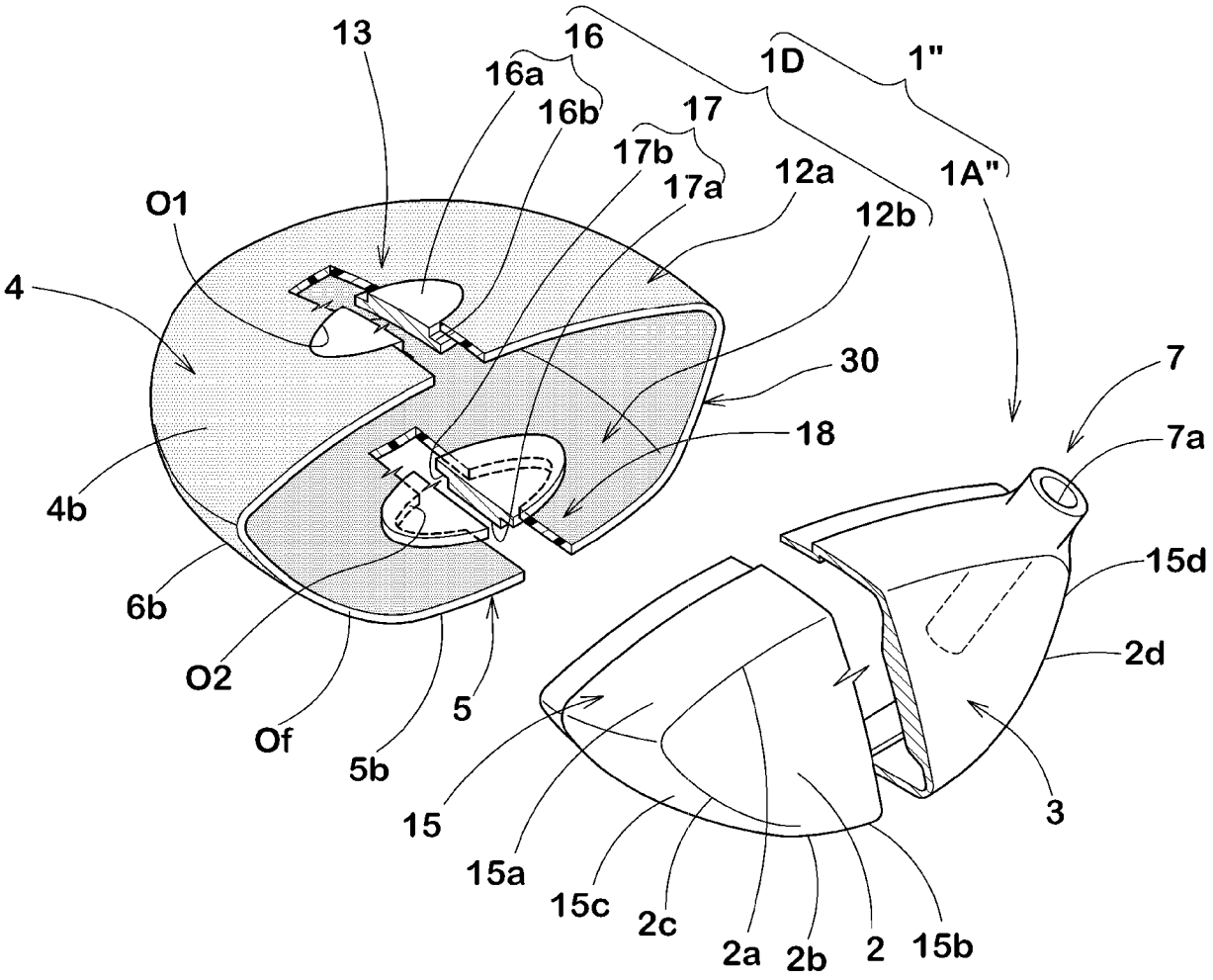
FIG. 7 is an exploded perspective view of another embodiment of the present invention.

FIG. 7 shows a head 1" of yet another embodiment of the present invention. The head 1" includes a face member 1A" having the face portion 3 and a back portion 1D to be fixed to a rear side of the face member 1A".

The face member 1A" of the embodiment is made of a metal material and includes the face portion 3 having the face 2, extension portions 15 extending from each edge 2*a* to 2*d* of the face 2 to the backward of the head, and the hosel portion 7. The extension portions 15 includes a crown-side extension portion 15*a*, a sole-side extension portion 15*b*, a toe-side extension portion 15*c* and a heel-side extension portion 15*d*.

The back portion 1D of the embodiment includes a crown rear 4*b*, a sole rear 5*b*, and a side rear 6*b* which respectively form major parts of the rear sides of a crown portion 4, a sole portion 5 and a side portion 6. The back portion 1D has a cup shape having a front side opening (of) to the front side to which the extension portion 15 of the face member 1A" is attached.

The back portion 10 includes: an upper first portions 16 made of a metal material and provided in the crown portion 4; an upper second portion 12*a* made of a fiber reinforced resin for supporting the upper first portion 16 so that the upper first portion 16 does not directly contact with the face member 1A"; a lower first portion 17 made of a metal material and provided in the sole portion 5; a lower second portion 12*b* made of a fiber reinforced resin for supporting the lower first portion 17 so that the lower first portion 17 does not directly contact with the face member 1A"; and a resin portion 30 made of a fiber reinforced resin and connected between the upper second portion and the lower second portion to form the cup shape.

The upper first portion 16 has an external surface 16*a* forming an outer surface 4*a* of the crown portion 4 and a step surface 16*b* which is depressed from the external surface 16*a* like a step. The lower first portion 17 has an external surface 17*a* forming an outer surface 5*a* of the sole portion 5 and a step surface 17*b* depressed from the external surface 17*a*.

The upper second portion 12*a* of the embodiment includes: an upper first opening o1 in which the upper first portion 16 on the crown side is disposed; and an upper first annular periphery 13 surrounding the upper first opening o1.

The lower second portion 12*b* of the embodiment includes: a lower first opening o2 in which the lower first portion 17 on the sole side is disposed; and a lower first annular periphery 18 surrounding the lower first opening o2.

In the embodiment, the upper first periphery 13 separates the upper first portion 16 on the crown wide from the face member 1A". Similarly, the second periphery 18 separates the lower first portion 17 on the sole side from the face member 1A".

In addition, the head 1" has a primary natural frequency of from 3800 to 6500 Hz. For the head 1", an antinode when the head vibrates in the primary natural mode appears in the upper and lower first portion 16 and 17.

Figure 8A:
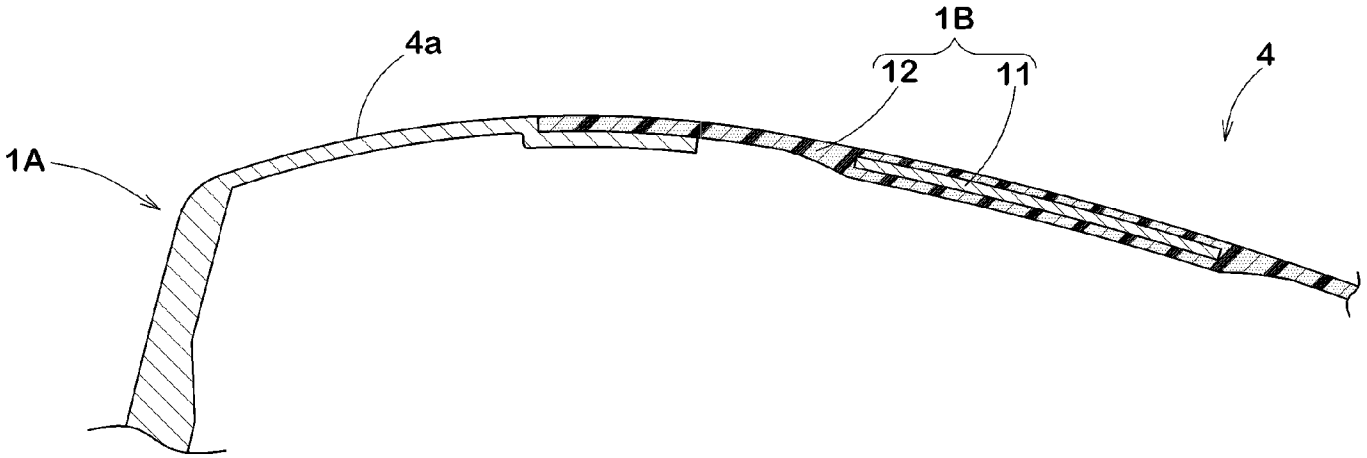
FIG. 8A and FIG. 8B are cross sectional views showing yet another embodiment of a crown portion.

FIG. 8A shows still yet another embodiment of the present invention. A first member 11 may be buried inside a second member 12. This can improve rigidity of a crown portion 4 without excessively reducing the effect of improving reverberation of hitting sound.

Figure 8B:
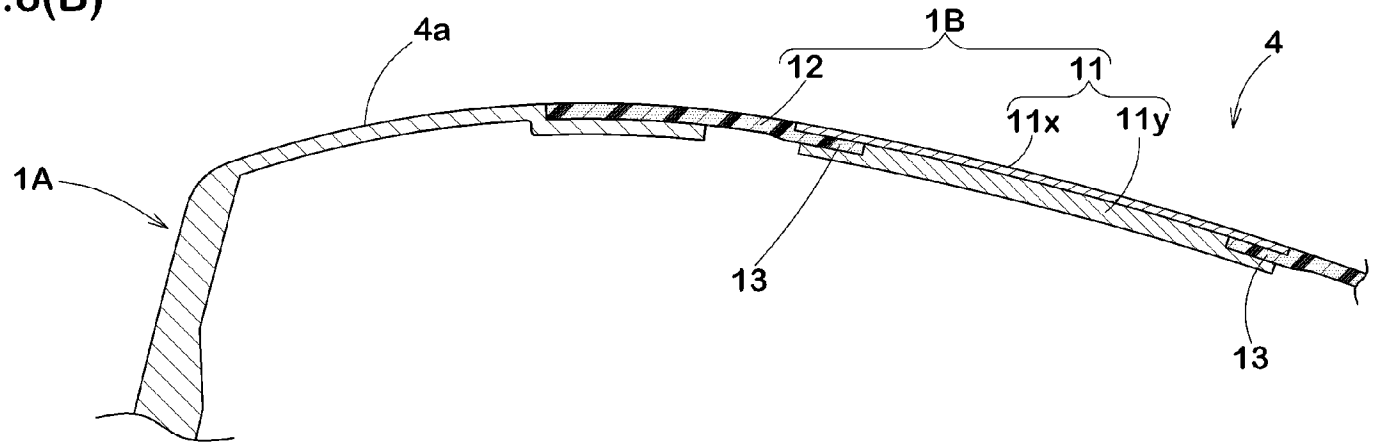

FIG. 8B shows yet another embodiment of the present invention. In the embodiment, a first member 11 includes an outer first member 11*x* and an inner first member 11*y* which sandwich a first periphery 13 of a second member 12.

The aspects shown in FIG. 8A and FIG. 8B may be applied to the first member 11, 17 disposed in the sole portion 5.

Although the present invention has been described so far in detail, the present invention is not limited to the specific embodiments described above and may be changed to different aspects as needed.

Comparative Test:

In order to confirm advantageous effects of the present invention, the heads as shown in FIG. 4, FIG. 6, FIG. 7, FIG. 9A, and FIG. 9B were prototyped, and each of them was tested on a restitution coefficient, height of the center of gravity, right and left moment of inertia, primary natural frequency, pitch of hitting sound, reverberation, and hit ball feeling. Except for the parameters listed in Table 1, the respective heads are all identical. Main common specifications and a test method are as follows:

Head weight: 190 g
Face member: Titanium alloy (Specific gravity: 4.5)
First member: Titanium alloy (Specific gravity: 4.5)
Second member: CFRP (Specific gravity: 1.9)
Rear side region: CFRP (Specific gravity 1.9)

Restitution Coefficient Test:

According to the "Procedure for Measuring the Velocity Ratio of a club Head for Conformance to Rule 4-1e, Appendix II, Revision 2 (Feb. 8, 1999), united States Golf Association.", the restitution coefficient "e" was obtained. The distance between the face of the club head and the launching device to produce a ball velocity of 160+/−0.5 fps was 55 inches. The radius of the target circle on the face was 5 mm. The golf balls used were "Titleist, PINNACLE GOLD."

$$Vo/Vi((eM(m)/(M(m)$$

Where
Vo: ball rebound velocity
Vi: ball incoming velocity
M: the mass of the club head
m: the mass of the ball.

Height of the Center of Gravity Test:

In the standard state, the height of the center of gravity, which is vertical height H (as shown in FIG. 3) from a horizontal surface to the sweet spot 55 was measured. The smaller a numeric value is, the better the performance is.

Moment of Inertia Test:

The moment of inertia Ma of the head around a vertical axis passing the center of gravity was measured with a moment of inertia measuring instrument, MODEL N0.005-002 manufactured by INERTIA DYNAMICS Inc. The larger the value, the better the performance is.

Primary Natural Frequency Test:

The primary natural frequency of the head was measured with the following method:

(a) Attach an acceleration pickup to a sole (sole external surface of the head).
(b) Attach a string to a neck portion of the head and suspend it from that string.
(c) Hit the sole external surface of the head with an impact hammer provided with a force pickup.
(d) obtain data of input exciting force F from the force pickup of the impact hammer.
(e) Obtain response acceleration spectrum A from the acceleration pickup.
(f) calculate "dynamic mass=input exciting force F/response acceleration spectrum A" to determine frequency of a primary minimum value of the dynamic mass. The value was made the primary natural frequency of the head.

In the step (a) above, if a position to attach the acceleration pickup is that of node of the primary natural frequency of the sole, no primary minimal value appears in the step (f) above. In this case, the position of the acceleration pickup was changed so that the primary minimal value appears. To measure the primary natural frequency, measuring equipment in the "impact hammer method" described in JP 2004-65570A1 is used. In addition, to attach the acceleration pickup to the sole, an adhesive, for example, is used.

Pitch of Hitting Sound, Reverberation, and Hit Ball Feeling Test:

A golf club shaft (MP700, Flex R manufactured by SRI sports Limited) made of FRP was mounted to each sample head and 45-inch wood type golf clubs were prototyped. Then, five 5- to 15-handicapped golfers hit 10 commercially available 3-piece golf balls ("XXIO XD" manufactured by SRI sports Limited) each with each club, and the pitch of hitting sound, length of reverberation of hitting sound, and hit ball feeling, which is a sum-up thereof, were evaluated according to the golfers' senses. The results are shown with a five-point method, in which 5 points are full marks, and the result in the reference 1 is made 3 points.

Table 1 shows test results and the like.

TABLE 1

Figure 9A:
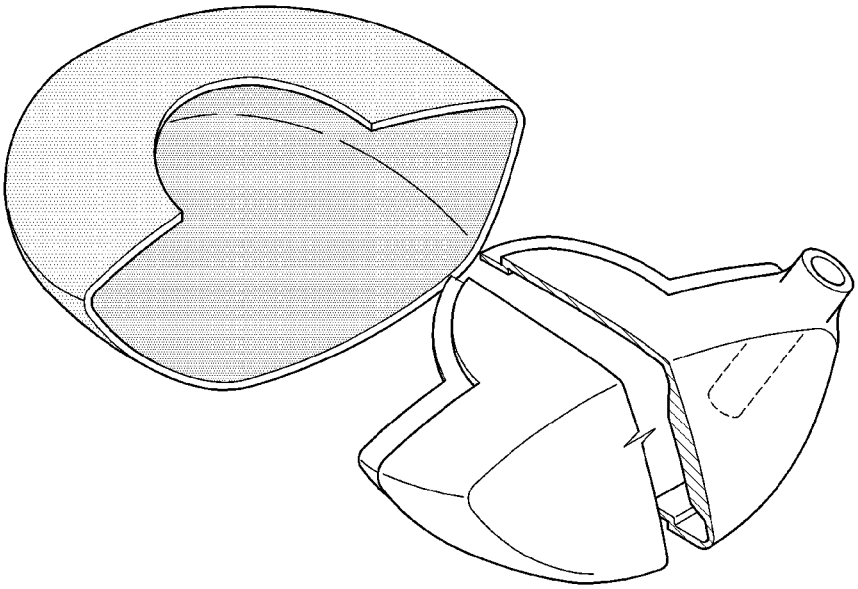
FIG. 9A and FIG. 9B are exploded perspective views of golf club heads showing comparative examples.
Figure 9B:
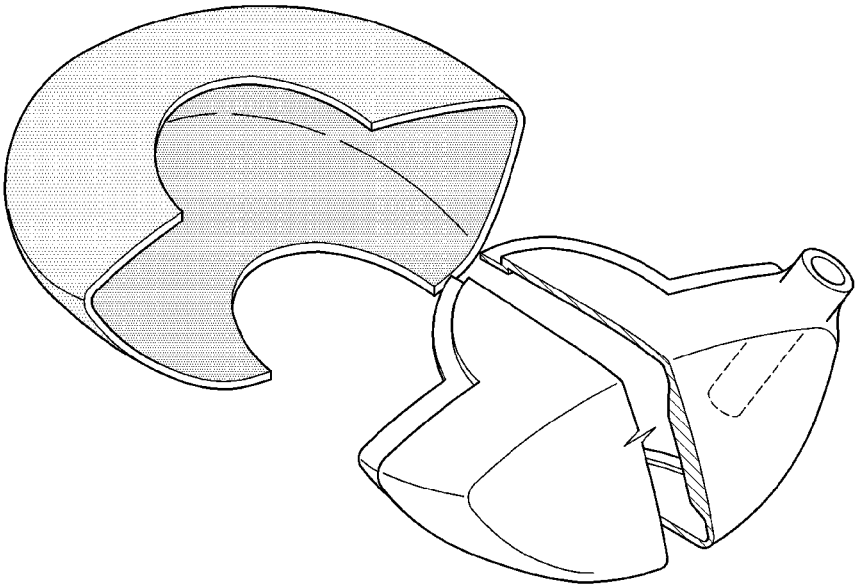

| | Ref. 1 | Ref. 2 | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Figure showing shape of a head | FIG. 9A | FIG. 9B | FIG. 4 | FIG. 4 | FIG. 4 | FIG. 4 | FIG. 4 | FIG. 4 | FIG. 6 | FIG. 7 |
| Amplitude ratio Si in a region where first member is disposed | — | — | 65% or more | 70% or more | 95% or more | 90% or more | 90% or more | 90% or more | 80% or more | 70% or more |
| Angleθ (deg.) of a long axis of first member | — | — | 0 | 0 | 0 | 15 | 5 | 0 | 0 | 0 |
| Restitution coefficient | 0.800 | 0.805 | 0.835 | 0.830 | 0.825 | 0.825 | 0.825 | 0.825 | 0.825 | 0.825 |
| Height of the center of gravity (mm) | 34.3 | 34.2 | 34.9 | 34.6 | 34.2 | 34.2 | 34.2 | 34.0 | 34.4 | 34.7 |
| Right and left moment of inertia ($gcm^2$) | 5200 | 5100 | 4200 | 4600 | 4950 | 4900 | 4900 | 4850 | 4900 | 4800 |
| Primary natural frequency (Hz) | 3000 | 3500 | 5800 | 5500 | 5050 | 5150 | 5100 | 5000 | 5400 | 5600 |
| Pitch of hitting sound [Score] | 3.0 | 3.2 | 4.5 | 4.5 | 4.3 | 4.5 | 4.5 | 4.5 | 4.6 | 4.7 |
| Reverberation of hitting sound [Score] | 2.5 | 2.7 | 5.0 | 4.8 | 4.2 | 4.4 | 4.6 | 4.7 | 4.6 | 4.7 |
| Hit ball feeling [Score] | 2.5 | 2.7 | 4.9 | 4.7 | 4.3 | 4.5 | 4.6 | 4.6 | 4.7 | 4.8 |

As a result of the tests, it could be confirmed that in the heads of the embodiments, the pitch of hitting sound, hit ball feeling, and moment of inertia were improved in a well-balanced manner, when compared with the heads of the comparison examples. Although similar tests were conducted using heads in which head weight, shaft length or head materials are varied, same tendency as the results of the testing was shown.

The invention claimed is:

1. A hollow golf club head comprising a face portion having a face for hitting a golf ball on its front and a crown portion forming a top surface of the head, wherein the head comprises a face member including the face portion and made of a metallic material and a crown member attached to the face member to form the crown portion at least partially, the crown member includes a first member made of a metal material and a second member made of a fiber reinforced resin for supporting the first member so that the first member does not directly contact with the face member, the head has a primary natural frequency in a range of from 3800 to 6500 Hz and an anti node when the head vibrates in the primary natural mode appears in the first member.

2. The head according to claim 1, wherein the second member comprises a first opening in which the first member is disposed and a first periphery annularly extending so as to surround the first opening.

3. The head according to claim 1, wherein the second member has a plate shape.

4. The head according to claim 1, wherein the head is a wood type golf club head.

* * * * *